US010036545B2

(12) United States Patent
Huang

(10) Patent No.: US 10,036,545 B2
(45) Date of Patent: Jul. 31, 2018

(54) DOWNLIGHT AND LIGHTING SYSTEM

(71) Applicants: BOE TECHNOLOGY GROUP CO., LTD., Beijing (CN); BOE OPTICAL SCIENCE AND TECHNOLOGY CO., LTD, Suzhou, Jiangsu (CN)

(72) Inventor: Pingping Huang, Beijing (CN)

(73) Assignees: BOE TECHNOLOGY GROUP CO., LTD., Beijing (CN); BOE OPTICAL SCIENCE AND TECHNOLOGY CO., LTD., Suzhou, Jiangsu (CN)

( * ) Notice: Subject to any disclaimer, the term of this patent is extended or adjusted under 35 U.S.C. 154(b) by 0 days.

(21) Appl. No.: 15/323,485

(22) PCT Filed: Mar. 4, 2016

(86) PCT No.: PCT/CN2016/075584
§ 371 (c)(1),
(2) Date: Jan. 3, 2017

(87) PCT Pub. No.: WO2017/045378
PCT Pub. Date: Mar. 23, 2017

(65) Prior Publication Data

US 2017/0314776 A1 Nov. 2, 2017
US 2018/0142880 A9 May 24, 2018

(30) Foreign Application Priority Data

Sep. 17, 2015 (CN) ..... 2015 1 0593619

(51) Int. Cl.
*F21V 29/00* (2015.01)
*F21V 23/04* (2006.01)
(Continued)

(52) U.S. Cl.
CPC ..... *F21V 29/77* (2015.01); *F21S 8/026* (2013.01); *F21V 3/0445* (2013.01);
(Continued)

(58) Field of Classification Search
CPC ..... F21V 29/77; F21V 3/0445; F21V 21/14; F21S 8/026
See application file for complete search history.

(56) References Cited

U.S. PATENT DOCUMENTS 8,220,970 B1 7/2012 Khazi et al.
8,882,311 B2 * 11/2014 Snell ..... F21V 13/04 362/147
(Continued)

FOREIGN PATENT DOCUMENTS

CN 201992428 U 9/2011
CN 102466162 A 5/2012
(Continued)

OTHER PUBLICATIONS

PCT (CN) International Search Report, Application No. PCT/CN2016/075584, dated May 30, 2016, 6 pps.; with English Translation.
(Continued)

*Primary Examiner* — Alan Cariaso
(74) *Attorney, Agent, or Firm* — Armstrong Teasdale LLP

(57) ABSTRACT

A downlight is provided. The downlight includes an insulating housing, a power supply assembly, a reflection cup, a LED light source, and a diffusion cover, wherein, the interior of the insulating housing is divided into a first cavity and a second cavity, the power supply assembly is arranged in the first cavity, the reflection cup is arranged in the second cavity, the LED light source is arranged in the reflection cup and connected with the power supply assembly, the reflection cup is configured to dissipate the heat of the LED light source and reflect the light from it to the open end of the second cavity, and the diffusion cover encapsulated in the open end of the second cavity is configured to diffuse the light.

14 Claims, 4 Drawing Sheets

(51) Int. Cl.

| | |
|---|---|
| ***F21V 29/77*** | (2015.01) |
| ***F21V 7/04*** | (2006.01) |
| ***F21V 23/02*** | (2006.01) |
| ***F21V 7/22*** | (2018.01) |
| ***F21S 8/02*** | (2006.01) |
| ***F21V 3/04*** | (2018.01) |
| ***F21V 25/00*** | (2006.01) |
| ***F21V 21/14*** | (2006.01) |
| ***F21V 3/06*** | (2018.01) |
| *F21Y 115/10* | (2016.01) |

(52) U.S. Cl.

CPC ..... *F21V 3/0625* (2018.02); *F21V 7/04* (2013.01); *F21V 7/22* (2013.01); *F21V 21/14* (2013.01); *F21V 23/02* (2013.01); *F21V 23/04* (2013.01); *F21V 23/0442* (2013.01); *F21V 25/00* (2013.01); *F21Y 2115/10* (2016.08)

(56) References Cited

U.S. PATENT DOCUMENTS

| | | | | |
|---|---|---|---|---|
| 9,291,319 | B2 * | 3/2016 | Kathawate | F21S 8/026 |
| 9,310,038 | B2 * | 4/2016 | Athalye | F21V 21/00 |
| 9,429,296 | B2 * | 8/2016 | Randolph | F21V 7/0091 |
| 9,557,021 | B2 * | 1/2017 | Madden | F21S 8/026 |
| 2014/0268790 | A1 * | 9/2014 | Chobot | F21V 23/0464 362/276 |
| 2015/0109792 | A1 * | 4/2015 | Ishida | F21V 29/004 362/294 |

FOREIGN PATENT DOCUMENTS

| | | | |
|---|---|---|---|
| CN | 102686933 | A | 9/2012 |
| CN | 203162768 | U | 8/2013 |
| CN | 203628395 | U | 6/2014 |
| CN | 203671377 | U | 6/2014 |
| CN | 104019409 | A | 9/2014 |
| CN | 204083860 | U | 1/2015 |
| CN | 104747933 | A | 7/2015 |
| CN | 105222010 | A | 1/2016 |
| JP | 2014137939 | A | 7/2014 |

OTHER PUBLICATIONS

PCT (CN) Written Opinion, Application No. PCT/CN2016/075584, dated May 30, 2016, 9 pps.; with English Translation.

China Patent Office Action, Application No. 2015105936192, dated Mar. 3, 2017, 11 pps.: with English Translation.

China Second Office Action, Application No. 2015105936192, dated Oct. 25, 2017, 19 pps.: with English Translation.

Yingshi Kang et al., Electrical Appliance Design, Mechanical Industry Publishing, Aug. 2012, pp. 35: with English Translation of Relevant Part.

* cited by examiner

DOWNLIGHT AND LIGHTING SYSTEM

CROSS-REFERENCES TO RELATED APPLICATIONS

This application is a National Stage entry of PCT/CN2016/075584 filed Mar. 4, 2016, which claims the benefit and priority of Chinese Patent Application No. 201510593619.2, filed on Sep. 17, 2015, both of which are incorporated herein by reference in their entirety.

BACKGROUND

Embodiment of the present disclosure relates to the technical field of display, especially to a downlight and lighting system.

As a lighting device embedded into the ceiling, the downlight is highly appreciated by many users. It is characterized mostly in keeping the integral unity and perfectness of the architectural ornaments, without damaging the aesthetics of the ceiling structure by installing of the lighting device. Especially the downlight employing LED light source has the advantages of a high lighting efficiency, power saving, and long working life. However, this kind of downlight has a relatively complicated structure, which results in complicated assembly and maintenance, and a high manufacturing cost. Moreover, a problem of heat dissipation of the LED light assembly exists, and also, the danger of electric shock resulted from a charged part contacting with a metal component when the metal component is touched by the consumer in using.

BRIEF DESCRIPTION

(1) Technical Problem to be Solved

The technical problem to be solved by the present disclosure is to provide a downlight, which may solve the problem of LED heat dissipation and also have the advantages of prevention from electric shocks, simple assembly, and a lower manufacturing cost.

(2) Technical Solutions

To solve the above technical problems, the present disclosure provides a downlight including an insulating housing, a power supply assembly, a reflection cup, a LED light source, and a diffusion cover, wherein, the interior of the insulating housing is divided into a first cavity and a second cavity, the power supply assembly is arranged in the first cavity, the reflection cup is arranged in the second cavity, the LED light source is arranged in the reflection cup and connected with the power supply assembly, the reflection cup is configured to dissipate the heat of the LED light source and reflect the light from it to the open end of the second cavity, the diffusion cover encapsulated in the open end of the second cavity is configured to diffuse the light.

According to an exemplary embodiment of the present disclosure, the insulating housing is made of a plastic material in one piece, and the shape of the second cavity is a trumpet shape matching with the reflection cup.

According to an exemplary embodiment of the present disclosure, an insulating rear cover is encapsulated in the open end of the first cavity, and is removably connected with the first cavity.

According to an exemplary embodiment of the present disclosure, circularly distributed receiving grooves with mounting holes are provided in the open end of the second cavity, and snaps with resilient clasps to be buckled into the mounting holes are provided on the diffusion cover.

According to an exemplary embodiment of the present disclosure, connector holders mounted with spring supports are provided on the exterior wall of the second cavity.

According to an exemplary embodiment of the present disclosure, the reflection cup is made of an aluminum material, the LED light source is arranged at the bottom of the reflection cup through a connecting member.

According to an exemplary embodiment of the present disclosure, a plurality of heat dissipation fins arranged at intervals are provided on the exterior wall of the second cavity, the mouth part of the reflection cup extends to the position of the heat dissipation fins along the interior wall of the second cavity.

The present disclosure also provides a lighting system including a switch unit and the downlight, wherein the switch unit is configured to turn on and off the downlight.

According to an exemplary embodiment of the present disclosure, the switch unit is a pushbutton switch or a voice control switch.

According to an exemplary embodiment of the present disclosure, the lighting system further includes a control unit configured to adjust the light of the downlight.

(3) Beneficial Effects

The technical solutions according to embodiments of the present disclosure have beneficial effects as follows: the downlight provided by the present disclosure can solve the problem of LED heat dissipation by adding a reflection cup in its interior, and with its exterior employing an insulating housing, has a function of electric shock proof, simple assembly, and a lower manufacturing cost.

DETAILED DESCRIPTION

Figure 1:
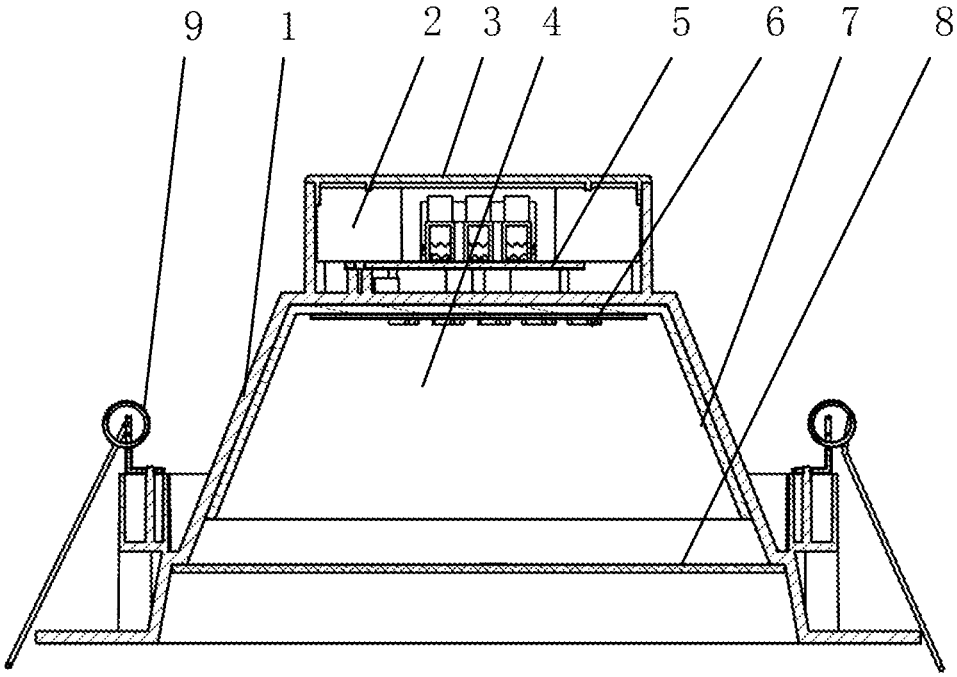
FIG. 1 is a cross-sectional view of a downlight in an embodiment of the present disclosure.

Specific implementation of the disclosure will be further described in detail in conjunction with drawings and embodiments. The following embodiments are used for illustrating the disclosure, not for limiting the scope thereof.

In the description of the present disclosure, it should be noted that, unless stated otherwise, "a plurality of" means two or more than two. The orientations or relationships between positions designated by "up", "down", "left", "right", "inside", "outside", "front", "rear", "head", "end" etc. are those shown in the drawings, and are intended for convenience and ease of description, not to designate or suggest that the designated device or element must have a particular orientation, be configured or operated in a particular orientation, and thus, should not be considered limitation of the present disclosure. Moreover, terms like "first", "second", "third" etc. are only used for description, not to be considered as indicating or suggesting relative importance.

In the description of the present disclosure, it should also be noted that, terms like "mounted", "connected", "coupled" should be comprehended broadly, unless specified and limited otherwise. For example, it may be fixed connection, removable connection, or integral connection, it may be mechanical connection, or electrical connection, it may be direct connection, or indirect connection through an intermediate medium. The specific meaning of the terms in the present disclosure may be understood based on the specific context by those of ordinary skill in the art.

As shown in FIG. 1-4, a downlight provided by the present embodiment includes an insulating housing 1, a power supply assembly 5, a reflection cup 7, a LED light source 6, and a diffusion cover 8. The insulating housing 1 made of an insulating material has the function of electric shock proof, and its interior is divided into a first cavity 2 and a second cavity 4. The power supply assembly 5 configured to supply power to the LED light source 6 is arranged in the first cavity 2, and the reflection cup 7 in the shape similar to a "cup" is arranged in the second cavity 4. The LED light source 6 is arranged in the reflection cup 7 and connected with the power supply assembly 5. The reflection cup 7 is for dissipating the heat of the LED light source 6 and reflecting its light to the open end of the second cavity 4 such that not only the problem of heat dissipation of the LED light source 6 can be effectively solved, but also the light can be reflected. Meanwhile, the diffusion cover 8 encapsulated in the open end of the second cavity 4 is used for diffusing the light such that the light is evenly distributed, not hurting one's eyes.

According to an exemplary embodiment of the present disclosure, the insulating housing 1 is made of a plastic material in one piece, that is, an integral all-plastic downlight. And, the shape of the second cavity 4 is a trumpet shape matching with the reflection cup 7. Of course, the inner surface of the reflection cup 7 is a reflection surface, through which the LED light source arranged at the bottom of the reflection cup 7 enables reflection of the light.

Figure 2:
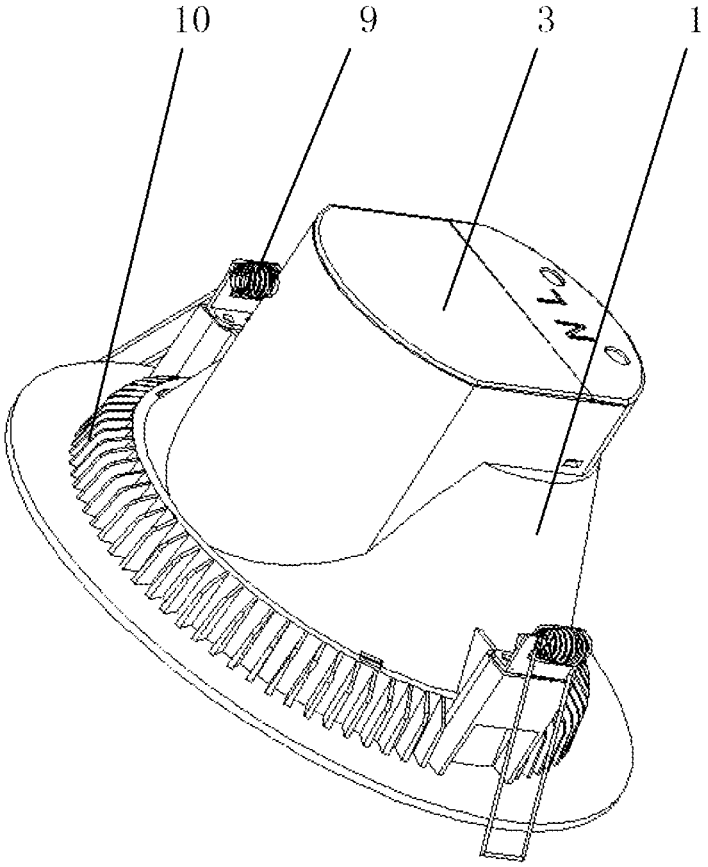
FIG. 2 is a perspective view of a downlight in an embodiment of the present disclosure.

As shown in FIG. 1 and FIG. 2, an insulating rear cover 3 removably connected with the second cavity 2 is encapsulated in the open end of the second cavity 2, and is configured to isolate the power supply assembly 5 from the outside for increasing the safety in using electricity.

Notably, in the present embodiment, the LED light source 6, the power supply assembly 5, and the diffusion cover 8 may be connected with the reflection cup 7 and the insulating housing 1 respectively by a connecting member. Here, the form of the connecting member is not limited, and may be configured flexibly according to the requirement of the implementation. For example, the connecting member may be any one of a snap connection, a threaded connection, or a slot connection.

According to an exemplary embodiment of the present disclosure, circularly distributed receiving grooves with mounting holes may be provided in the open end of the second cavity 4. Correspondingly, snaps with resilient clasps to be buckled into the mounting holes may be provided on the diffusion cover 8. The resilient clasps may be bucked into the mounting holes through plastic deformation and hook the mounting holes for secure connection.

According to an exemplary embodiment of the present disclosure, connector holders mounted with spring supports 9 are provided on the exterior wall of the second cavity 4. The spring supports 9 can be used to mount the downlight in the ceiling conveniently and quickly. Of course, the form of the spring support 9 may also be configured flexibly. For example, the spring support 9 may include a spring body provided with a spring fixing part formed by bending its coil outwards, and two spring arms extending outwards from the two ends of the spring body.

The form of the reflection cup 7 may also be various, either an integral or a combined type. And, the material of the reflection cup 7 is mainly made of a metal material with good heat dissipation, and the heat emitted from the LED light source may be transferred outwards through the reflection cup 7.

According to an exemplary embodiment of the present disclosure, the reflection cup 7 is made of an aluminum material, and the LED light source is arranged at the bottom of the reflection cup (the bottom inside the reflection cup 7) by a connecting member, thus, the heat produced from the LED light source 6 may be dissipated through the reflection cup 7.

Figure 3:
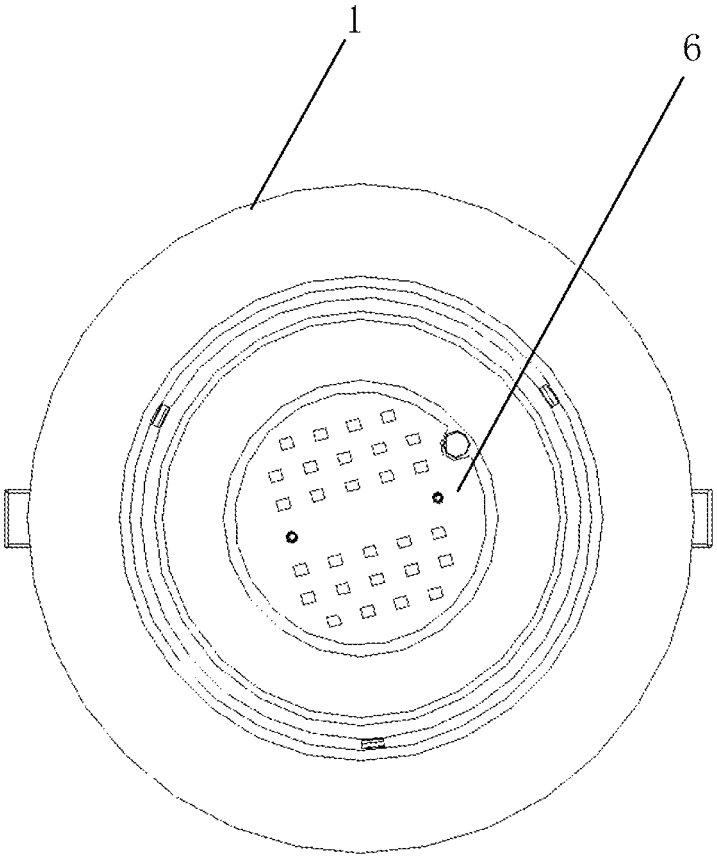
FIG. 3 is a front view of a downlight in an embodiment of the present disclosure.
Figure 4:
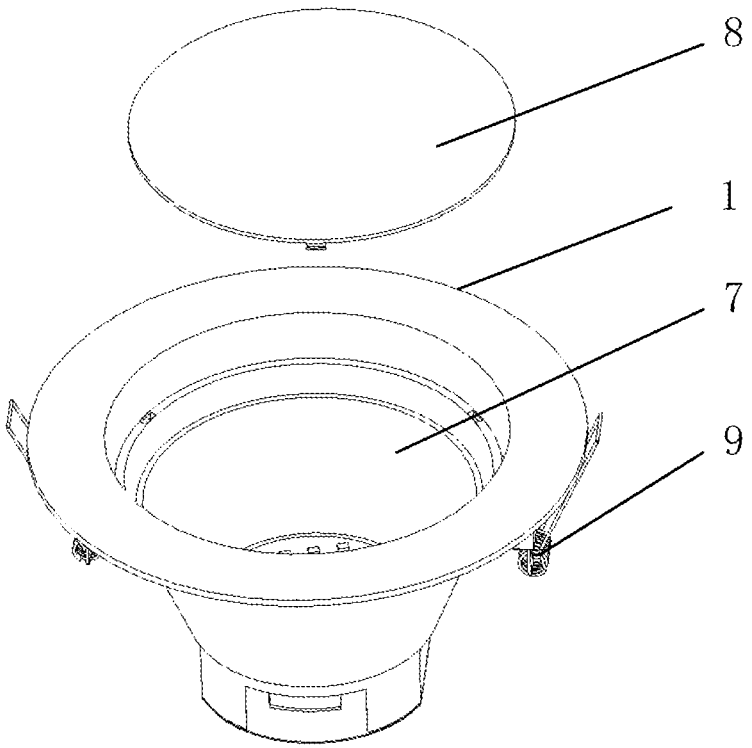
FIG. 4 is an exploded view of a downlight in an embodiment of the present disclosure.

With reference to FIG. 3 and FIG. 4, a plurality of heat dissipation fins 10 (shown in FIG. 2) arranged at intervals are provided on the exterior edge of the second cavity 4 (shown in FIG. 1), and the mouth part of the reflection cup 7 extends to the position of the heat dissipation fins along the interior wall of the second cavity, so that the heat dissipation fins may, to some extent, perform the function of enhancing heat dissipation, and meanwhile make the overall structure more aesthetically pleasing.

Moreover, as a light transmitting structure, the diffusion cover 8 may be manufactured from polymer resin, ABS resin, flame retardant, and hardener. Of course, the diffusion cover 8 may also use a light transmitting cover in the prior art, for the purpose of making the light scattered evenly.

Based on the above embodiment, the present disclosure also provides a lighting system including a switch unit configured to turn on and off the downlight. Further, the switch unit may be a pushbutton switch or a voice control switch. The pushbutton switch is a switch utilizing a pushbutton to drive a transmission mechanism to connect or disconnect a movable contact and an immovable contact, thus, enabling close and open of the circuit. The voice control switch is an energy-saving electronic switch employing the sound effect in a particular environmental light to activate a voice pickup to perform acoustic to electric conversion for controlling the starting of an electric appliance and being able to switch off the power supply automatically after a time delay.

Moreover, the lighting system also includes a control unit configured to adjust the light from the downlight.

Notably, the downlight of the present disclosure may be applied adequately to various smart lighting systems, so as to satisfy their requirement of lighting and energy-saving. This is described specifically with reference to the following examples.

Example 1

The lighting system may further include a body displacement control module and a power supply drive module, and the body displacement control module connected with the power supply drive module is configured to control the power supply drive module to change the output signal to the downlight according to different detected body displacements, which realizes the effective control of the light according to the body displacement, and realizes the detection of the body heat source resting in the detection zone.

Example 2

The lighting system may further include an acoustic sensor and a light sensor communicatively connected with the control unit respectively, the light sensor is configured to realize adjusting the downlight according to the ambient illumination to protect the eyes by brightening and darkening gradually, the acoustic sensor and a speech recognition unit are configured to realize smart operations by speech recognition.

In summary, the downlight provided by the present disclosure can solve the problem of LED heat dissipation by adding a reflection cup in its interior, meanwhile, its exterior, employing a insulating housing, has a function of electric shock proof, a simple assembly, and a low manufacturing cost.

Embodiments of the present disclosure are for exemplification and illustration, not exhaustive or to limit the present disclosure to the disclosed form. Many modifications and variations are apparent to those skilled in the art. Selection and description of the embodiments are for better illustrating the principle and actual application of the present disclosure and enabling those skilled in the art to understand the present disclosure to design various embodiments with various modifications suited for particular applications.

What is claimed is:

1. A downlight comprising: an insulating housing, a power supply assembly, a reflection cup, a LED light source, and a diffusion cover; wherein, an interior of the insulating housing is divided into a first cavity and a second cavity, the power supply assembly is arranged in the first cavity, the reflection cup is arranged in the second cavity, the LED light source is arranged in the reflection cup and connected with the power supply assembly, the reflection cup is configured to dissipate heat from the LED light source and reflect the light from the LED light source to an open end of the second cavity, and the diffusion cover encapsulated in the open end of the second cavity is configured to diffuse the light;

wherein, a plurality of heat dissipation fins arranged at intervals are provided on an exterior wall of the second cavity, a mouth part of the reflection cup extends to a position of the plurality of heat dissipation fins along an interior wall of the second cavity.

2. The downlight according to claim 1, wherein, the insulating housing is made of a plastic material in one piece, and a shape of the second cavity is a trumpet shape matching a shape of the reflection cup.

3. The downlight according to claim 1, wherein, an insulating rear cover is encapsulated in an open end of the first cavity, and is removably connected with the first cavity.

4. The downlight according to claim 1, wherein, circularly distributed receiving grooves with mounting holes are provided in the open end of the second cavity, and snaps with resilient clasps for buckling into the mounting holes are provided on the diffusion cover.

5. The downlight according to claim 1, wherein, connector holders mounted with spring supports are provided on an exterior wall of the second cavity.

6. The downlight according to claim 1, wherein, the reflection cup is made of an aluminum material, the LED light source is arranged at a bottom of the reflection cup through a connecting member.

7. A lighting system comprising: a switch unit and a downlight, wherein the downlight comprises an insulating housing, a power supply assembly, a reflection cup, a LED light source, and a diffusion cover; wherein, an interior of the insulated housing is divided into a first cavity and a second cavity, the power supply assembly is arranged in the first cavity, the reflection cup is arranged in the second cavity, the LED light source is arranged in the reflection cup and connected with the power supply assembly, the reflection cup is configured to dissipate heat from the LED light source and reflect the light from the LED light source to an open end of the second cavity, and the diffusion cover encapsulated in the open end of the second cavity is configured to diffuse the light, wherein, a plurality of heat dissipation fins arranged at intervals are provided on an exterior wall of the second cavity, a mouth part of the reflection cup extends to a position of the plurality of heat dissipation fins along an interior wall of the second cavity, and wherein the switch unit is configured to turn on and off the downlight.

8. The lighting system according to claim 7, wherein, the switch unit is a pushbutton switch or a voice control switch.

9. The lighting system according to claim 7, wherein, the lighting system further comprises a control unit configured to adjust the light of the downlight.

10. The lighting system according to claim 7, wherein, the insulating housing is made of a plastic material in one piece, and a shape of the second cavity is a trumpet shape matching a shape of the reflection cup.

11. The lighting system according to claim 7, wherein, an insulating rear cover is encapsulated in an open end of the first cavity, and is removably connected with the first cavity.

12. The lighting system according to claim 7, wherein, circularly distributed receiving grooves with mounting holes are provided in the open end of the second cavity, and snaps with resilient clasps for buckling into the mounting holes are provided on the diffusion cover.

13. The lighting system according to claim 7, wherein, connector holders mounted with spring supports are provided on an exterior wall of the second cavity.

14. The lighting system according to claim 7, wherein, the reflection cup is made of an aluminum material, the LED light source is arranged at a bottom of the reflection cup through a connecting member.

* * * * *